US009884489B2

(12) United States Patent
Ohnishi

(10) Patent No.: US 9,884,489 B2
(45) Date of Patent: Feb. 6, 2018

(54) INKJET PRINTER, PRINTING METHOD, AND PRINTING SYSTEM

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/321,191

(22) PCT Filed: Jun. 25, 2015

(86) PCT No.: PCT/JP2015/068294
§ 371 (c)(1),
(2) Date: Dec. 22, 2016

(87) PCT Pub. No.: WO2015/199166
PCT Pub. Date: Dec. 30, 2015

(65) Prior Publication Data

US 2017/0136783 A1 May 18, 2017

(30) Foreign Application Priority Data

Jun. 25, 2014 (JP) ..... 2014-130736

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 29/393; B41J 29/38
USPC ..... 347/16, 19, 101, 102, 104
See application file for complete search history.

(56) References Cited

FOREIGN PATENT DOCUMENTS

| | | |
|---|---|---|
| JP | 2005-349250 | 12/2005 |
| JP | 2010-280828 | 12/2010 |

OTHER PUBLICATIONS

"International Search Report (Form PCT/ISA/210)", dated Jul. 28, 2015, pp. 1-4, with English translation thereof.
"Office Action of China Counterpart Application," with English translation thereof, dated Jul. 24, 2017, p. 1-p. 14.

*Primary Examiner* — Jannelle M Lebron
(74) *Attorney, Agent, or Firm* — JCIPRNET

(57) ABSTRACT

To provide an inkjet printer capable of satisfactorily performing printing on a media made of a variety of materials. An inkjet printer includes a laser light irradiation device configured to irradiate a surface of a medium with laser light, thereby forming recesses in at least a portion of the surface of the medium, and an inkjet head configured to eject ink, thereby supplying the ink onto the surface of the medium having the recesses formed therein. The inkjet printer may further include an irradiation position adjusting unit configured to adjust a position on the medium to be irradiated with laser light, such that a plurality of the recesses is formed inside the outline of a pattern to be formed by ink, and a supply position adjusting unit configured to adjust an ink supply position on the medium such that the ink is supplied to the recesses.

6 Claims, 16 Drawing Sheets

INKJET PRINTER, PRINTING METHOD, AND PRINTING SYSTEM

CROSS-REFERENCE TO RELATED APPLICATION

This application is a 371 application of International PCT application serial no. PCT/JP2015/068294, filed on Jun. 25, 2015, which claims the priority benefit of Japan application no. 2014-130736, filed on Jun. 25, 2014. The entirety of each of the above-mentioned patent applications is hereby incorporated by reference herein and made a part of this specification.

TECHNICAL FIELD

The present invention relates to an inkjet printer, a printing method, and a printing system.

BACKGROUND ART

As disclosed in Patent Literature 1 (PTL 1), an inkjet printer has an inkjet head for ejecting ink. Ink ejected from the inkjet head is supplied onto a medium, whereby printing is performed on that medium.

CITATION LIST

Patent Literature

PTL 1: JP-A-2010-280828

SUMMARY OF INVENTION

Technical Problem

There are media made of a variety of materials such as paper, glass, metals, and plastics. It is desired to devise a technology capable of satisfactorily performing printing on such media made of a variety of materials.

An object of the present invention is to provide an inkjet printer, a printing method, and a printing system capable of satisfactorily performing printing on media made of a variety of materials.

Solution to Problem

A first aspect of the present invention provides an inkjet printer including a laser light irradiation device configured to irradiate a surface of a medium with laser light, thereby forming recesses in at least a portion of the surface of the medium, and an inkjet head configured to supply ink onto the surface of the medium having the recesses formed therein.

According to the first aspect of the present invention, recesses can be smoothly formed in media made of a variety of materials by irradiation with laser light. If ink enters recesses formed in a medium, the contact area between a resin component (a binder) contained in the ink and the medium increases. As a result, the ink can adhere to the medium with high adhesiveness. Therefore, for example, even if ink is supplied onto a medium made of a material having low affinity for the ink, printing is satisfactorily performed on that medium with the ink.

In the first aspect of the present invention, the inkjet printer may include an irradiation position adjusting unit configured to adjust a position on the medium to be irradiated with the laser light such that the plurality of recesses is formed inside the outline of a pattern to be formed on the medium, and a supply position adjusting unit configured to adjust a supply position of the ink on the medium such that the ink is supplied to the recesses.

In this case, it is possible to smoothly form a desired pattern on a medium by forming a plurality of recesses in a pattern area and then supplying ink onto the pattern area.

In the first aspect of the present invention, the inkjet printer may include an irradiation quantity adjusting unit configured to adjust the quantity of irradiation of the medium with the laser light, wherein the irradiation quantity adjusting unit can adjust the quantity of irradiation with the laser light such that at least a portion of the medium is cut by the laser light.

In this case, the laser light irradiation device can fulfill both of a surface modification function of forming recesses in a surface of a medium and a cutting function of cutting at least a portion of a medium. Therefore, the inkjet printer can fulfill both of a printing function and a cutting plotter function.

In the first aspect of the present invention, the inkjet printer may include an incident-angle adjusting unit configured to adjust an incident angle of the laser light on the surface of the medium.

In this case, it is possible to form recesses in a surface of a medium at various angles.

In the first aspect of the present invention, the incident-angle adjusting unit may adjust the incident angle such that the laser light enters one region of the surface of the medium at a first incident angle, and enters the one region at a second incident angle different from the first incident angle.

In this case, each recess is formed such that the size of the bottom of the recess is larger than the size of the opening of the upper end of the recess. Therefore, ink having entered the recesses can adhere to the medium with high adhesiveness by a high anchor effect.

In the first aspect of the present invention, the inkjet printer may include a heating device configured to heat the medium with respect to supply of the ink.

In this case, adhesiveness between ink and the medium is improved.

A second aspect of the present invention provides a printing method including a process of irradiating a surface of a medium with laser light, thereby forming recesses in at least a portion of the surface of the medium, and a process of supplying ink onto the surface of the medium irradiated with the laser light, thereby forming an image on the medium during printing.

According to the second aspect of the present invention, since the ink adheres to the medium with high adhesiveness, printing is satisfactorily performed on that medium with the ink.

A third aspect of the present invention provides a printing system including a medium moving device configured to have a supporting unit for supporting a medium and move the medium supported on the supporting unit, a laser light irradiation device configured to irradiate a surface of the medium supported on the supporting unit with laser light, thereby forming recesses in at least a portion of the surface of the medium, and an inkjet device configured to eject ink, thereby supplying the ink onto the surface of the medium having the recesses formed therein.

According to the third aspect of the present invention, since the ink adheres to the medium with high adhesiveness, printing is satisfactorily performed on that medium with the ink.

Advantageous Effects of Invention

According to the aspects of the present invention, the inkjet printer, the printing method, and the printing system capable of satisfactorily performing printing on media made of a variety of materials are provided.

DESCRIPTION OF EMBODIMENTS

Hereinafter, embodiments according to the present invention will be described with reference to drawings; however, the present invention is not limited thereto. Requisites for the individual embodiments to be described below can be appropriately combined. Also, some components may not be used.

In the following description, a Cartesian coordinate system with X, Y, and Z axes is set, and the positional relation of individual units will be described with reference to the Cartesian coordinate system with the X, Y, and Z axes. One direction specified in a predetermined plane is defined as an X axis direction, and a direction specified in the predetermined plane and perpendicular to the X axis direction is defined as a Y axis direction, and a direction perpendicular to both of the X axis direction and the Y axis direction is defined as a Z axis direction. Also, rotation (inclination) directions about the X axis, the Y axis, and the Z axis are defined as θX, θY, and θZ directions, respectively.

<First Embodiment>

A first embodiment will be described.

Figure 1:
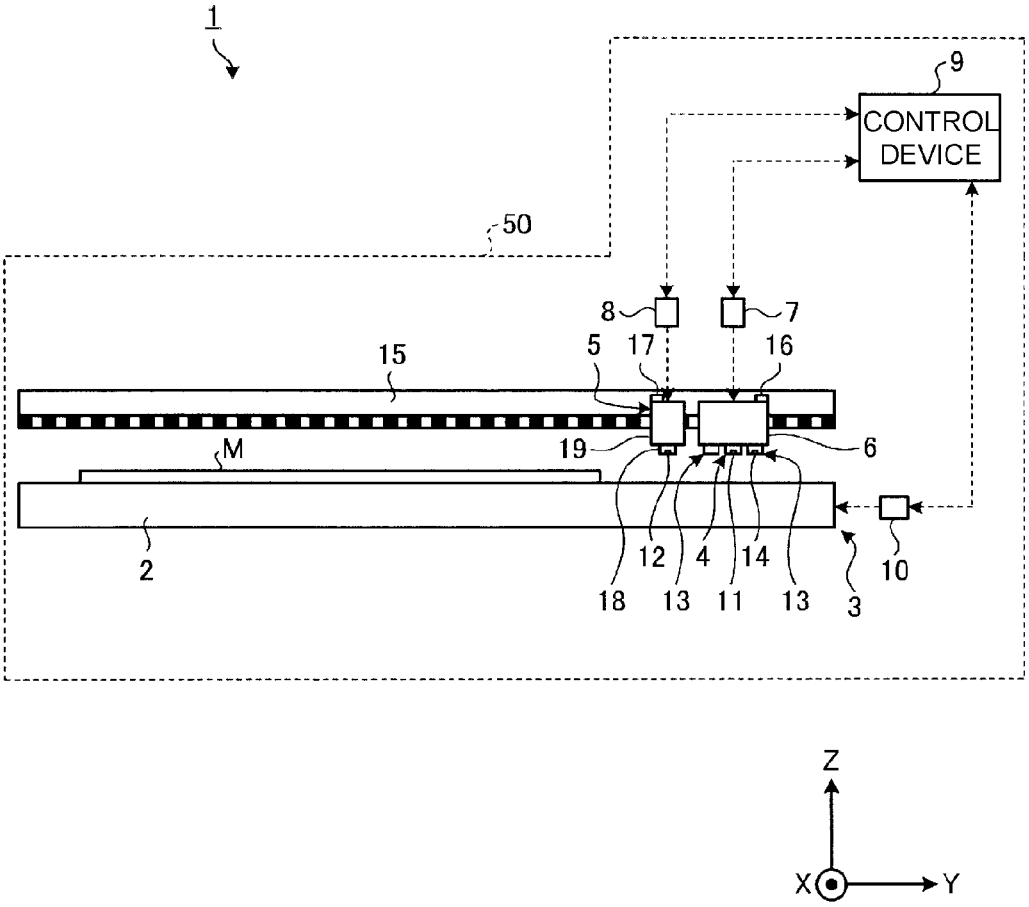
FIG. 1 is a schematic configuration diagram illustrating an example of an inkjet printer according to a first embodiment.

FIG. 1 is a schematic configuration diagram illustrating an example of an inkjet printer 1 according to the present embodiment. As shown in FIG. 1, the inkjet printer 1 includes a medium moving device 3 configured to have a supporting unit 2 for supporting a medium M and move each medium M supported on the supporting unit 2, an inkjet head 4 for supplying ink onto each medium M supported on the supporting unit 2, a laser light irradiation device 5 for irradiating each medium M supported on the supporting unit 2 with laser light, a carriage 6 for holding the inkjet head 4, and a carriage moving device 7 for moving the carriage 6, a laser moving device 8 for moving the laser light irradiation device 5, a control device 9 for controlling the inkjet printer 1, and a housing 50.

Inside the housing 50, the medium moving device 3, the inkjet head 4, the laser light irradiation device 5, the carriage 6, the carriage moving device 7, the laser moving device 8, and the control device 9 are disposed.

The inkjet printer 1 supplies ink ejected from the inkjet head 4 onto a medium M, thereby forming an image on the medium M. The inkjet printer 1 can use ink made of a variety of materials. Ink may be ultraviolet curing ink (UV ink), or may be solvent ultraviolet curing ink (SUV ink), or may be latex ink, or may be solvent ink, or may be water-based ink. In the present embodiment, ink is solvent evaporation type inkjet ink. Ink capable of forming thin color ink coats with thicknesses of 30 μm or less is used.

The inkjet printer 1 can use media M made of a variety of materials. The materials of media M may be paper, or may be glass, or may be metals, or may be plastics. The materials of media M may be selected from paper, glass, fabric, stainless steel, brass, alumite, silicon rubber, polypropylene, polyethylene, polycarbonate, polytetrafluoroethylene, polyethylene terephthalate, polyimide, polyurethane, vinyl chloride, silicon resins, acrylic resins, and ABS (acrylonitrile-butadiene-styrene) resins.

The medium moving device 3 moves each medium M in a sub scan direction perpendicular to a main scan direction. In the present embodiment, the sub scan direction is the X axis direction. The medium moving device 3 includes the supporting unit 2 for supporting each medium M, and a drive device 10 for moving each medium M. The medium moving device 3 is controlled by the control device 9. An operation of the drive device 10 including an actuator causes each medium M supported on the supporting unit 2 to move. The supporting unit 2 includes, for example, a platen. The drive device 10 includes a conveyance roller, and a drive motor for driving the conveyance roller. Also, the supporting unit 2 may include a table, and the drive device 10 may include an actuator for moving that table.

The inkjet head 4 ejects ink, thereby supplying that ink onto a medium M. The inkjet head 4 is controlled by the control device 9. The inkjet head 4 has an ejection port 11 for ejecting ink. The inkjet head 4 is movable to a position facing a surface of a medium M.

The laser light irradiation device 5 emits laser light, thereby irradiating a medium M with the laser light. The laser light irradiation device 5 includes a laser light irradiator 18 having an emitting unit 12 for emitting laser light, and a holding member 19 for holding the laser light irradiator 18. The laser light irradiation device 5 is controlled by the control device 9. The laser light irradiation device 5 is movable to a position facing a surface of a medium M.

The carriage 6 holds the inkjet head 4. In the present embodiment, the carriage 6 holds an ultraviolet-light irradiator 13 for emitting ultraviolet light (UV light). The ultraviolet-light irradiator 13 can emit ultraviolet light, thereby irradiating a medium M with that ultraviolet light. The ultraviolet-light irradiator 13 is controlled by the control device 9. The ultraviolet-light irradiator 13 has an emitting unit 14 for emitting ultraviolet light. In a case where ink is ultraviolet curing ink, ink supplied on a medium M is irradiated with ultraviolet light emitted from the ultraviolet-light irradiator 13.

The carriage moving device 7 moves the carriage 6 in the main scan direction. In the present embodiment, the main scan direction is the Y axis direction. The carriage 6 is supported on a guide member 15 so as to be movable. The guide member 15 guides the carriage 6 in the Y axis direction. The carriage moving device 7 includes an actuator, and can move the carriage 6 which can be guided on the guide member 15, in the Y axis direction. The carriage moving device 7 includes a conveyance belt which is connected, for example, to the carriage 6, and a drive motor for driving the conveyance belt. The carriage moving device 7 is controlled by the control device 9. The carriage 6 moves in the Y axis direction, whereby the inkjet head 4 and the ultraviolet-light irradiator 13 move in the Y axis direction, together with the carriage 6.

The laser moving device 8 moves the laser light irradiation device 5 in the main scan direction (the Y axis direction). The laser light irradiation device 5 is supported on the guide member 15, so as to be movable. In the present embodiment, the holding member 19 is supported on the guide member 15 so as to be movable. The guide member 15 guides the laser light irradiation device 5 in the Y axis direction. The laser moving device 8 includes an actuator, and can move the laser light irradiation device 5 which can be guided on the guide member 15, in the Y axis direction. The laser moving device 8 includes a conveyance belt which is connected, for example, to the holding member 19, and a drive motor for driving that conveyance belt. The laser moving device 8 is controlled by the control device 9. The holding member 19 moves in the Y axis direction, whereby the laser light irradiator 18 moves in the Y axis direction, together with the holding member 19.

The inkjet head 4 can be moved in the Y axis direction by an operation of the carriage moving device 7. The laser light irradiation device 5 can be moved in the Y axis direction by an operation of the laser moving device 8. In the present embodiment, the inkjet head 4 and the laser light irradiation device 5 can separately move.

Also, the laser light irradiator 18 may be held on the carriage 6. In this case where the laser light irradiator 18 is held on the carriage 6, the carriage 6 is moved by an operation of the carriage moving device 7 in the Y axis direction, whereby the inkjet head 4 and the laser light irradiator 18 move in the Y axis direction, together with the carriage 6. In the case where the laser light irradiator 18 is held on the carriage 6, the laser moving device 8 and the holding member 19 can be omitted.

In the present embodiment, the inkjet printer 1 includes a position detecting device 16 for detecting the position of the inkjet head 4, and a position detecting device 17 for detecting the position of the laser light irradiation device 5.

The position detecting device 16 is disposed on the carriage 6 (the inkjet head 4), and includes an encoder head for detecting scales of a scale member supported on the guide member 15. The scale member includes a plate member long in the Y axis direction. The plurality of scales is disposed on the plate member in the Y axis direction at predetermined intervals. The encoder head irradiates the scale member with detection light, thereby detecting the scales of the scale member. A detection signal of the encoder head is output to the control device 9. On the basis of the detection signal of the encoder head, the control device 9 acquires data on the position of the inkjet head 4 relative to the Y axis direction.

The position detecting device 17 is disposed on the holding member 19 (the laser light irradiator 18), and includes an encoder head for detecting the scales of the scale member supported on the guide member 15. A detection signal of the encoder head is output to the control device 9. On the basis of the detection signal of the encoder head, the control device 9 acquires data on the position of the laser light irradiation device 5 relative to the Y axis direction.

Figure 2:
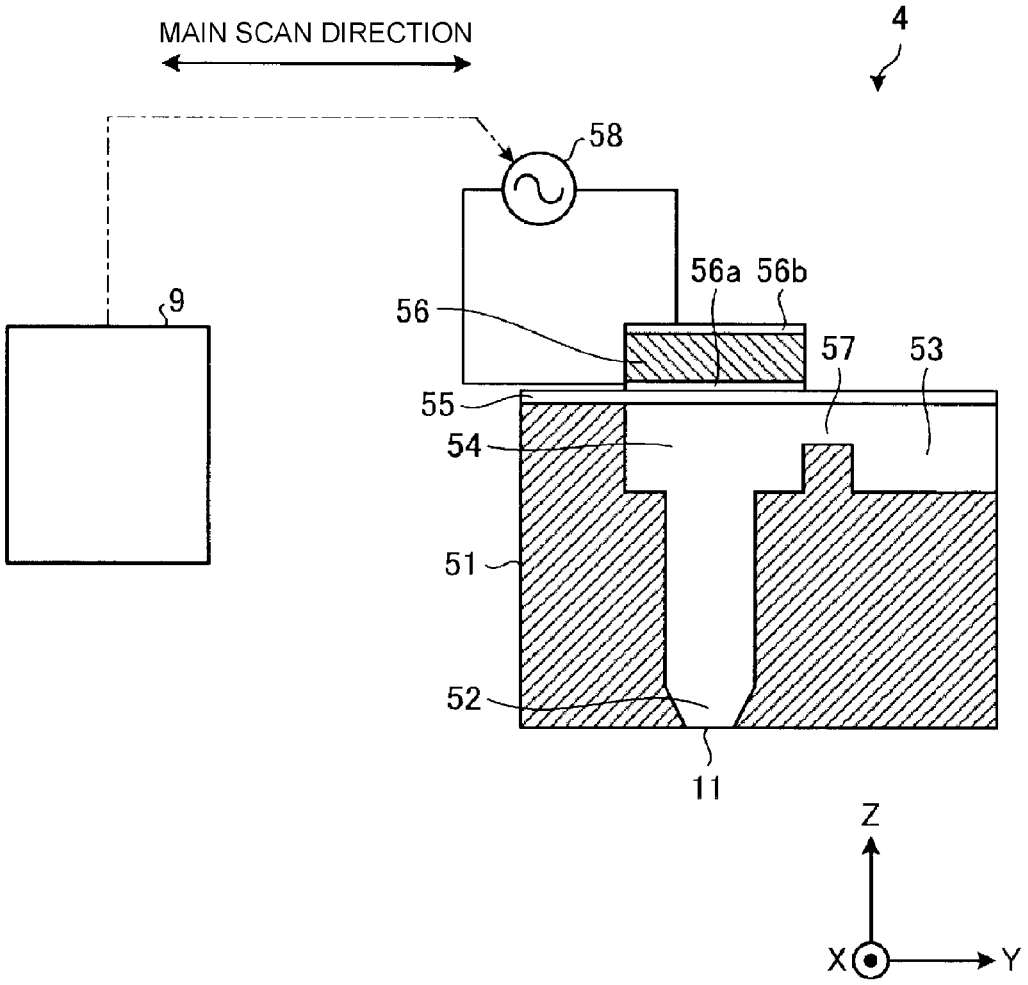
FIG. 2 is a cross-sectional view schematically illustrating an example of an inkjet head according to the first embodiment.

FIG. 2 is a cross-sectional view schematically illustrating an example of the inkjet head 4 according to the present embodiment. As shown in FIG. 2, the inkjet head 4 includes a main body 51, a nozzle 52, an introduction port 53, an ink chamber 54, a diaphragm 55, and a piezoelectric element 56. The nozzle 52 is formed in the main body 51. The central axis of the nozzle 52 is parallel to the Z axis. The nozzle 52 has the ejection port 11 for ejecting ink. Ink ejected from the ejection port 11 is supplied onto a medium M. The introduction port 53 is connected to the nozzle 52 through a groove 57. The ink chamber 54 is connected to both of the nozzle 52 and the introduction port 53. The ink chamber 54 is formed between the main body 51 and the diaphragm 55. The lower surface of the diaphragm 55 faces the ink chamber 54. The piezoelectric element 56 vibrates the diaphragm 55. The piezoelectric element 56 is disposed on the upper surface of the diaphragm 55. The piezoelectric element 56 includes a piezo element. A lower electrode **56*a* and an upper electrode 56*b* are connected to the piezoelectric element 56. The lower electrode 56*a* and the upper electrode 56*b* are connected to a power source 58 for supplying electric power to the piezoelectric element 56. The piezoelectric element 56 is controlled by the control device 9. Ink is introduced from an ink tank into the introduction port 53. The introduced ink is temporarily stored in the ink chamber 54. The piezoelectric element 56 vibrates the diaphragm 55, whereby ink is ejected from the ejection port 11 of the nozzle 52** in an inkjet manner.

Figure 3:
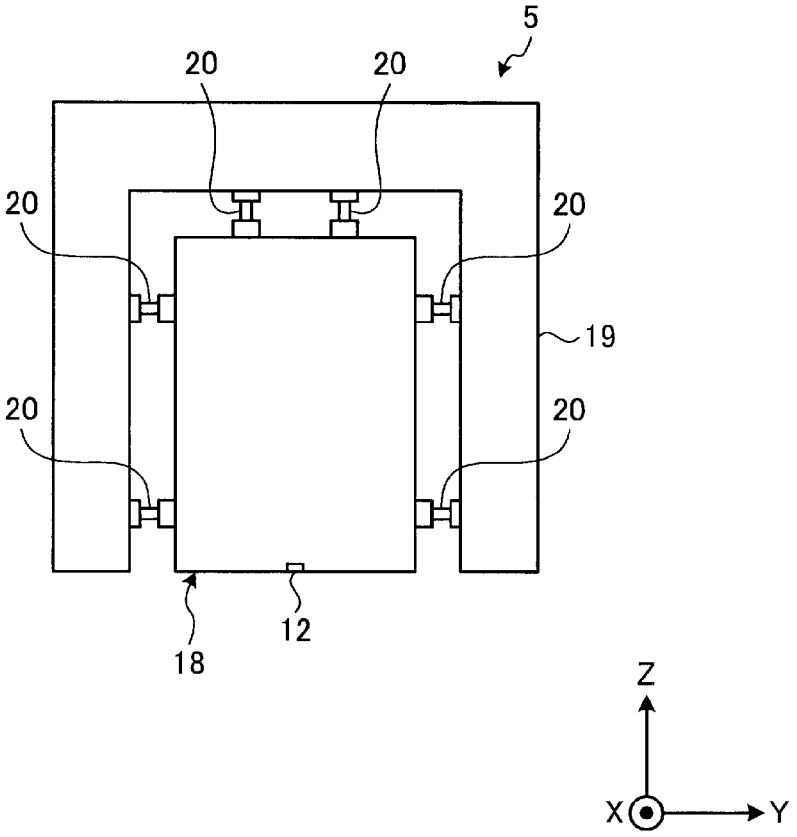
FIG. 3 is a view schematically illustrating an example of a laser light irradiation device according to the first embodiment.

FIG. 3 is a view schematically illustrating an example of the laser light irradiation device 5 according to the present embodiment. As shown in FIG. 3, the laser light irradiation device 5 includes the laser light irradiator 18 having the emitting unit 12 for emitting laser light, and the holding member 19 for holding the laser light irradiator 18.

The laser light irradiation device 5 includes a plurality of actuators 20 disposed between the holding member 19 and the laser light irradiator 18. The actuators 20 are controlled by the control device 9. The control device 9 adjusts the position (posture) of the laser light irradiator 18 relative to the holding member 19 by controlling the plurality of actuators 20. In the present embodiment, the control device 9 moves the laser light irradiator 18 in six directions of the X axis direction, the Y axis direction, the Z axis direction, the θX direction, the θY direction, and the θZ direction, by controlling the plurality of actuators 20. According to operations of the actuators 20, the direction of the emitting unit 12 varies. The control device 9 controls the actuators 20, thereby changing the direction of the emitting unit 12, thereby adjusting the traveling direction of laser light emitted from the emitting unit 12.

Figure 4:
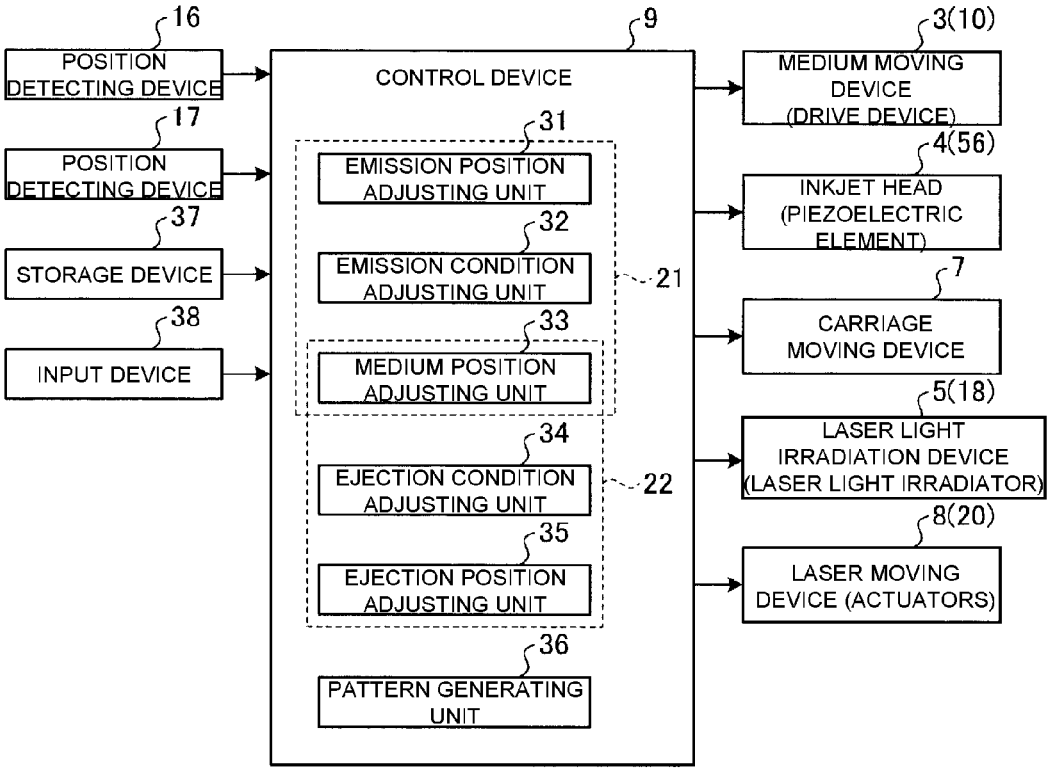
FIG. 4 is a functional block diagram illustrating an example of a control system of the inkjet printer according to the first embodiment.

FIG. 4 is a functional block diagram illustrating an example of a control system of the inkjet printer 1 according to the present embodiment. As shown in FIG. 4, the control device 9 includes an emission position adjusting unit 31 for adjusting the position of the emitting unit 12 of the laser light irradiator 18, an emission condition adjusting unit 32 for adjusting a condition for emission of laser light from the emitting unit 12, a medium position adjusting unit 33 for adjusting the position of a medium M, an ejection condition adjusting unit 34 for adjusting a condition for ejection of ink from the ejection port 11, an ejection position adjusting unit 35 for adjusting the position of the ejection port 11 of the inkjet head 4, and a pattern generating unit 36 for generating a pattern (an object pattern) to be formed on a medium M.

In the present embodiment, the control device 9 includes an irradiation position adjusting unit 21 for adjusting a position on a medium M to be irradiated with laser light, and a supply position adjusting unit 22 for adjusting an ink supply position on the medium M. The irradiation position adjusting unit 21 includes the emission position adjusting unit 31, the emission condition adjusting unit 32, and the medium position adjusting unit 33. The supply position adjusting unit 22 includes the ejection position adjusting unit 35, the ejection condition adjusting unit 34, and the medium position adjusting unit 33.

The emission position adjusting unit 31 adjusts the position of the laser light irradiator 18 relative to the guide member 15 by controlling the laser moving device 8. Also, the emission position adjusting unit 31 adjusts the position of the laser light irradiator 18 relative to the holding member 19 by controlling the actuators 20. The position of the laser light irradiator 18 is adjusted, whereby the position of the emitting unit 12 is adjusted. The laser moving device 8 adjusts the position of the emitting unit 12 relative to the Y axis direction with a resolution lower than that of the actuators 20. The actuators 20 adjust the position of the emitting unit 12 relative to six directions of the X axis direction, the Y axis direction, the Z axis direction, the θX direction, the θY direction, and the θZ direction, with a resolution higher than that of the laser moving device 8. The actuators 20 may be referred to as the fine moving devices, and the laser moving device 8 may be referred to as the rough moving device.

In the following description, the actuators 20 and the laser moving device 8 will be appropriately combined and be collectively referred to as the laser moving device 8. The laser moving device 8 can adjust the position of the emitting unit 12 relative to six directions of the X axis direction, the Y axis direction, the Z axis direction, the θX direction, the θY direction, and the θZ direction. The emission position adjusting unit 31 can adjust the position of the emitting unit 12 relative to six directions of the X axis direction, the Y axis direction, the Z axis direction, the θX direction, the θY direction, and the θZ direction, by controlling the laser moving device 8.

The emission condition adjusting unit 32 adjusts the output of the laser light irradiator 18. The output of the laser light irradiator 18 is adjusted, whereby the intensity (light quantity) of laser light to be emitted from the emitting unit 12 is adjusted. The intensity of laser light to be emitted from the emitting unit 12 is adjusted, whereby the illuminance of laser light for a medium M is adjusted. Also, the emission condition adjusting unit 32 adjusts the time of emission of laser light from the emitting unit 12. The time of emission of laser light from the emitting unit 12 is adjusted, whereby the time of irradiation of a medium M with laser light is adjusted. The emission condition adjusting unit 32 adjusts at least one of the illuminance and emission time of laser light for a medium M, thereby adjusting the quantity of irradiation of the medium M with laser light. The emission condition adjusting unit 32 functions as an irradiation quantity adjusting unit for adjusting the quantity of irradiation of a medium M with laser light. Also, the emission condition adjusting unit 32 performs emission and stop of laser light from the emitting unit 12.

The ejection position adjusting unit 35 adjusts the position of the inkjet head 4 held on the carriage 6, by controlling the carriage moving device 7. The position of the inkjet head 4 is adjusted, whereby the position of the ejection port 11 is adjusted. In the present embodiment, the position of the ejection port 11 relative to the Y axis direction is adjusted by the carriage moving device 7. In addition to the carriage moving device 7, a fine moving device capable of adjusting the position of the inkjet head 4 relative to the carriage 6 may be provided. The fine moving device may be used to adjust the position of the ejection port 11 relative to six directions of the X axis direction, the Y axis direction, the Z axis direction, the θX direction, the θY direction, and the θZ direction.

The ejection condition adjusting unit 34 adjusts the amplitude and vibration frequency of the piezoelectric element 56. The amplitude and vibration frequency of the piezoelectric element 56 are adjusted, whereby the amount of ink to be ejected from the ejection port 11 of the inkjet head 4, and timings for ejecting ink (so-called ejection pitches) are adjusted. The ejection condition adjusting unit 34 functions as a supply amount adjusting unit for adjusting the amount of supply of ink onto a medium M. Also, the ejection condition adjusting unit 34 performs ejection and stop of ink from the ejection port 11.

The medium position adjusting unit 33 adjusts the position of a medium M supported on the supporting unit 2, by controlling the drive device 10 of the medium moving device 3. In the present embodiment, the medium moving device 3 is usable to adjust the position of a medium M relative to the X axis direction.

The irradiation position adjusting unit 21 includes the emission position adjusting unit 31, the emission condition adjusting unit 32, and the medium position adjusting unit 33, and adjusts a position on a medium M to be irradiated with laser light. The relative positions of the emitting unit 12 and a medium M in the X-Y plane can be adjusted by the emission position adjusting unit 31 and the medium position adjusting unit 33. In this way, a position on a medium M to be irradiated with laser light can be adjusted. The emission condition adjusting unit 32 performs emission and stop of laser light from the emitting unit 12. While the emitting unit 12 and a medium M relatively move in the X-Y plane, emission and stop of laser light are performed by the emission condition adjusting unit 32, whereby a position (irradiation area) on the medium M to be irradiated with laser light is adjusted.

In the present embodiment, while moving in the Y axis direction, the emitting unit 12 radiates laser light onto a medium M, whereby irradiation of the medium M with laser light corresponding to one line is performed. After irradiation with laser light corresponding to one line is performed, the medium M moves in the X axis direction by a distance corresponding to one line. After the medium M moves in the X axis direction by the distance corresponding to one line, while the emitting unit 12 moves in the Y axis direction, it irradiates the medium M with laser light, whereby irradiation of the medium M with laser light corresponding to one line is performed. The operation of irradiating the medium M with laser light while moving the emitting unit 12 in the Y axis direction, and the operation of moving the medium M in the X axis direction are repeated, whereby a predetermined area on the surface of the medium M is irradiated with laser light.

The supply position adjusting unit 22 includes the ejection position adjusting unit 35, the ejection condition adjusting unit 34, and the medium position adjusting unit 33, and adjusts an ink supply position on a medium M. The relative positions of the ejection port 11 and a medium M in the X-Y plane can be adjusted by the ejection position adjusting unit 35 and the medium position adjusting unit 33. In this way, an ink supply position on a medium M can be adjusted. The ejection condition adjusting unit 34 performs ejection and stop of ink from the ejection port 11. While the ejection port 11 and a medium M relatively move in the X-Y plane, ejection and stop of ink are performed by the ejection condition adjusting unit 34, whereby the ink supply position (supply area) on the medium M is adjusted.

In the present embodiment, while moving in the Y axis direction, the ejection port 11 supplies ink onto a medium M, whereby ink corresponding to one line is supplied onto the medium M. After supply of ink corresponding to one line is performed, the medium M moves in the X axis direction by a distance corresponding to one line. After the medium M moves in the X axis direction by the distance corresponding to one line, while the ejection port 11 moves in the Y axis direction, it supplies ink onto the medium M, whereby ink corresponding to one line is supplied onto the medium M. The operation of supplying ink onto the medium M while moving the ejection port 11 in the Y axis direction, and the operation of moving the medium M in the X axis direction are repeated, whereby ink is supplied onto a predetermined area of the surface of the medium M.

The pattern generating unit 36 generates an object pattern to be formed on a medium M. The object pattern includes an image. On the basis of the object pattern generated by the pattern generating unit 36, the irradiation position adjusting unit 21 adjusts a position on the medium M to be irradiated with laser light. On the basis of the object pattern generated by the pattern generating unit 36, the supply position adjusting unit 22 adjusts an ink supply position on the medium M.

As shown in FIG. 4, the position detecting device 16, the position detecting device 17, a storage device 37, and an input device 38 are connected to the control device 9. The storage device 37 is for storing a variety of data relative to printing. The input device 38 includes input devices such as a keyboard, a mouse, and a touch panel. If the input device 38 is operated, an input signal is generated. The generated input signal is supplied to the control device 9.

Figure 5:
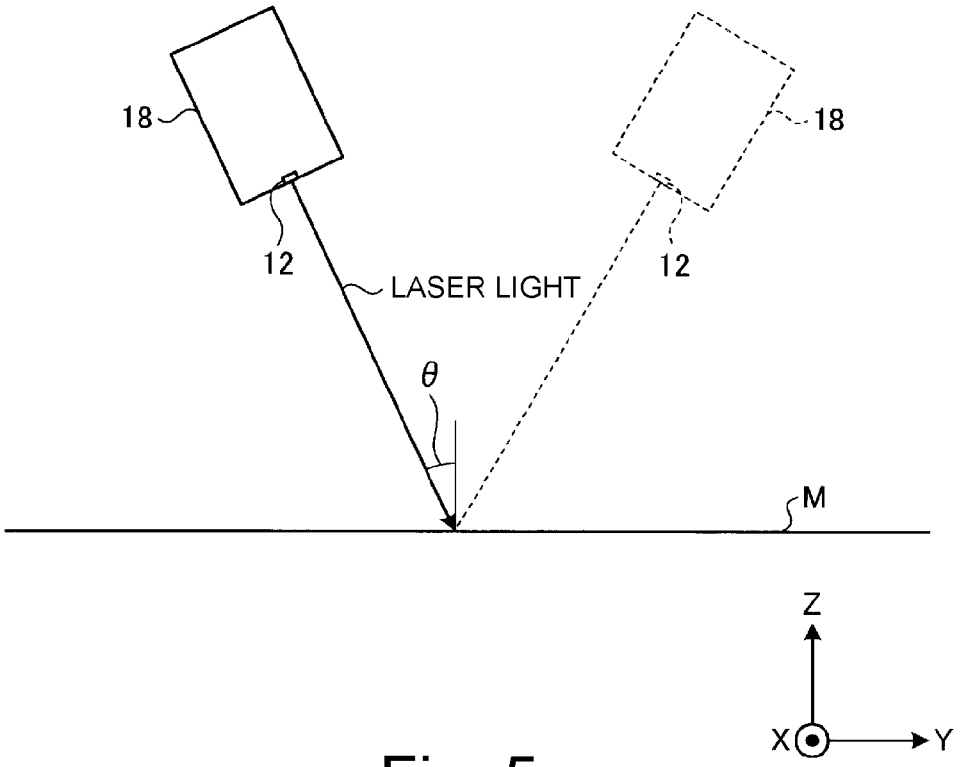
FIG. 5 is a schematic diagram for explaining an example of an operation of a laser light irradiator according to the first embodiment.

FIG. 5 is a schematic diagram for explaining an example in which the direction of the emitting unit 12 changes according to an operation of the laser moving device 8 including the actuators 20. As described above, according to an operation of the laser moving device 8, the laser light irradiator 18 can move in six directions of the X axis direction, the Y axis direction, the Z axis direction, the θX direction, the θY direction, and the θZ direction. As shown in FIG. 5, as the position (posture) of the laser light irradiator 18 changes, the direction of the emitting unit 12 changes. As the direction of the emitting unit 12 changes, the traveling direction of laser light emitted from the emitting unit 12 changes. As a result, the incident angle θ of laser light on a surface of a medium M changes.

The emission position adjusting unit 31 can adjust an incident angle θ of laser light on a surface of a medium M by adjusting the position (posture) of the laser light irradiator 18. The emission position adjusting unit 31 functions as an incident-angle adjusting unit for adjusting an incident angle θ of laser light on a surface of a medium M.

Figure 6:
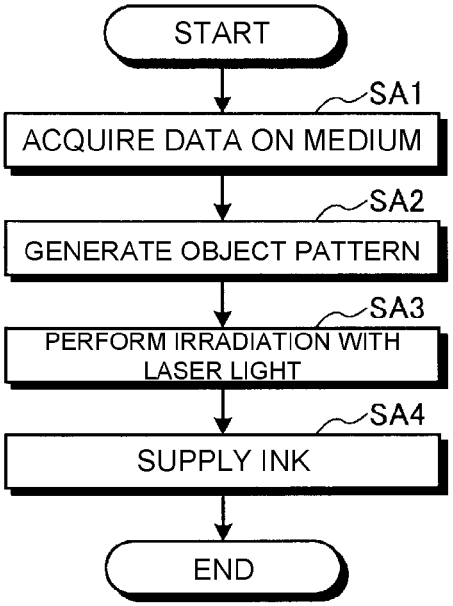
FIG. 6 is a flow chart illustrating an example of a printing method according to the first embodiment.

Now, an example of a method of performing printing on a medium M with the above-described inkjet printer 1 (forming an object image in a desired area like a medium M) will be described. FIG. 6 is a flow chart illustrating an example of the printing method according to the present embodiment. In the present embodiment, a process of acquiring data on a medium M (STEP SA1), a process of generating an object pattern 70 (STEP SA2), a process of forming recesses 40 in at least a portion of a surface of the medium M by irradiating the surface of the medium M with laser light on the basis of the generated object pattern 70 (STEP SA3), and a process of performing printing on the medium M by supplying ink onto the surface of the medium M irradiated with the laser light (STEP SA4) are performed.

The data on the medium M is acquired (STEP SA1). The data on the medium M includes data on the material of the medium M. The material of the medium M includes the heat resistance of the medium M. The heat resistance of the medium M includes its melting temperature or evaporating temperature. On the basis of the material of the medium M, a condition for emission of laser light is set. The data on the material of the medium M is stored in the storage device 37. The control device 9 acquires the data on the material of the medium M from the storage device 37. Alternatively, the control device 9 may acquire the data on the material of the medium M on the basis of an input signal supplied from the input device 38.

Figure 7:
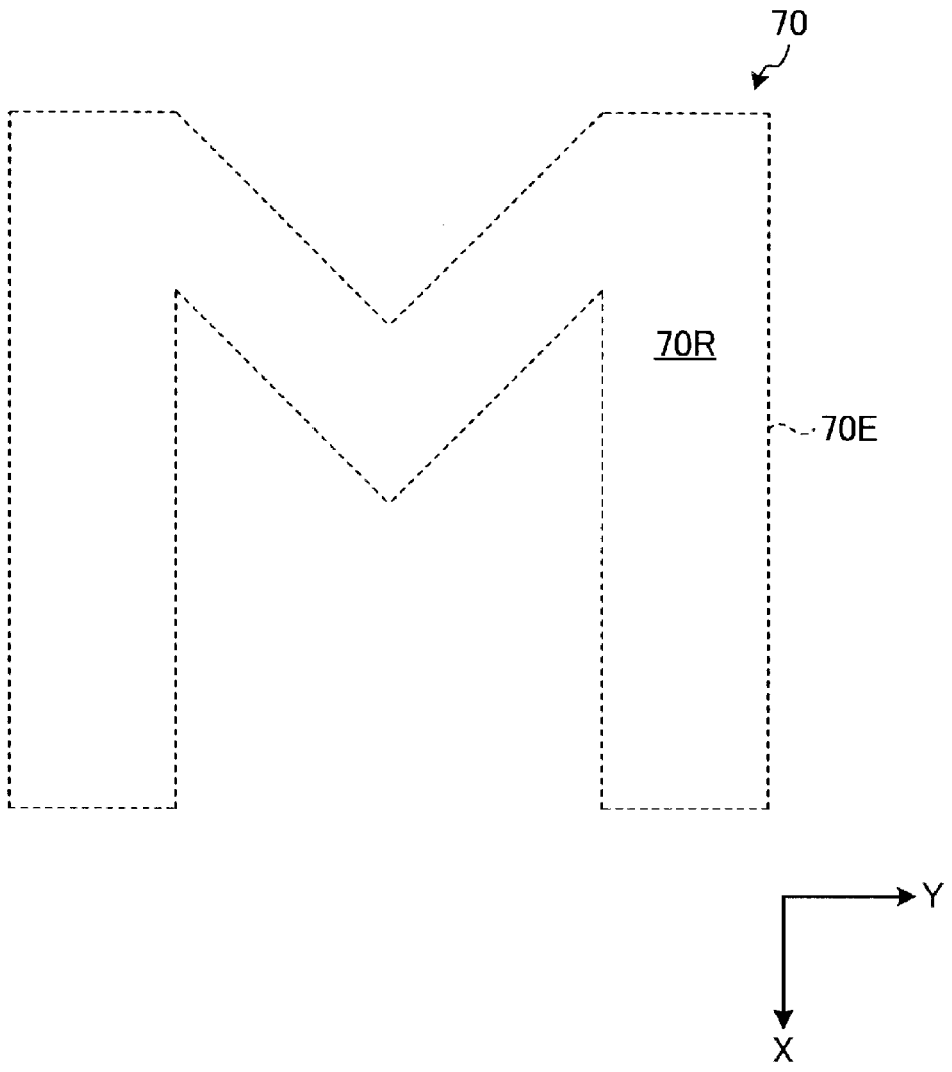
FIG. 7 is a view illustrating an example of a pattern generated by a pattern generating unit according to the first embodiment.

The object pattern 70 is generated by the pattern generating unit 36 (STEP SA2). The object pattern 70 may include characters, and may include images. In the present embodiment, as an example, it is assumed a case where an object pattern 70 as shown in FIG. 7 is generated.

On the basis of the data on the material of the medium M, the emission condition adjusting unit 32 sets a condition for emission of laser light. After a condition for emission of laser light is set, on the basis of the generated object pattern 70 and the condition set for emission of laser light, the laser light irradiation device 5 irradiates the surface of the medium M with laser light, thereby forming recesses 40 in at least a portion of the surface of the medium M (STEP SA3).

Figure 8:
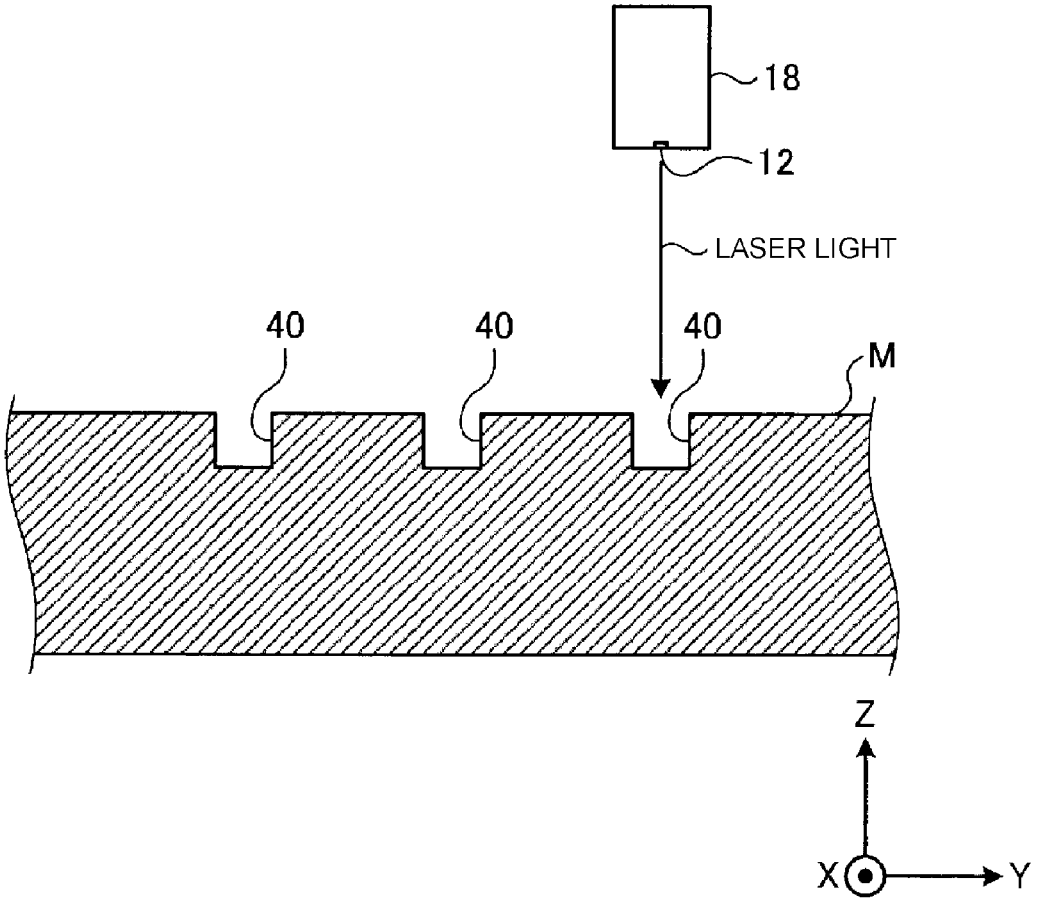
FIG. 8 is a schematic diagram illustrating an example of an operation of the laser light irradiator according to the first embodiment.

FIG. 8 is a cross-sectional view schematically illustrating examples of the recesses 40 formed in the surface of the medium M by irradiation with laser light. The surface of the medium M is irradiated with laser light emitted from the emitting unit 12, whereby the recesses 40 are formed in the surface of the medium M. The emission condition adjusting unit 32 adjusts the quality of irradiation of the medium M with laser light such that the recesses 40 having a desired depth are formed in the surface of the medium M. The emission condition adjusting unit 32 adjusts at least one of the illuminance of laser light and the irradiation time, for example, such that irradiation with laser light does not cause the medium M to be cut and does not cause through-holes to be formed in the medium M. The quantity of irradiation with laser light for forming the recesses 40 having the desired depth depends on the material (heat resistance) of the medium M. On the basis of the data on the material of the medium M acquired in STEP SA1, the emission condition adjusting unit 32 adjusts the quantity of irradiation with laser light such that the recesses 40 having the desired depth are formed.

In the present embodiment, the storage device 37 retains the relationship (map data) of the material of the medium M, the heat resistance of that material, and the quantity of irradiation with laser light optimal for forming the recesses 40 having the desired depth in the medium M made of that material. If data on the material name of the medium M is input from the input device 38, the emission condition adjusting unit 32 determines the quantity of irradiation with laser light optimal for forming the recesses 40 having the desired depth in the medium M, on the basis of the data input from the input device 38 and the map data of the storage device 37.

Figure 9:
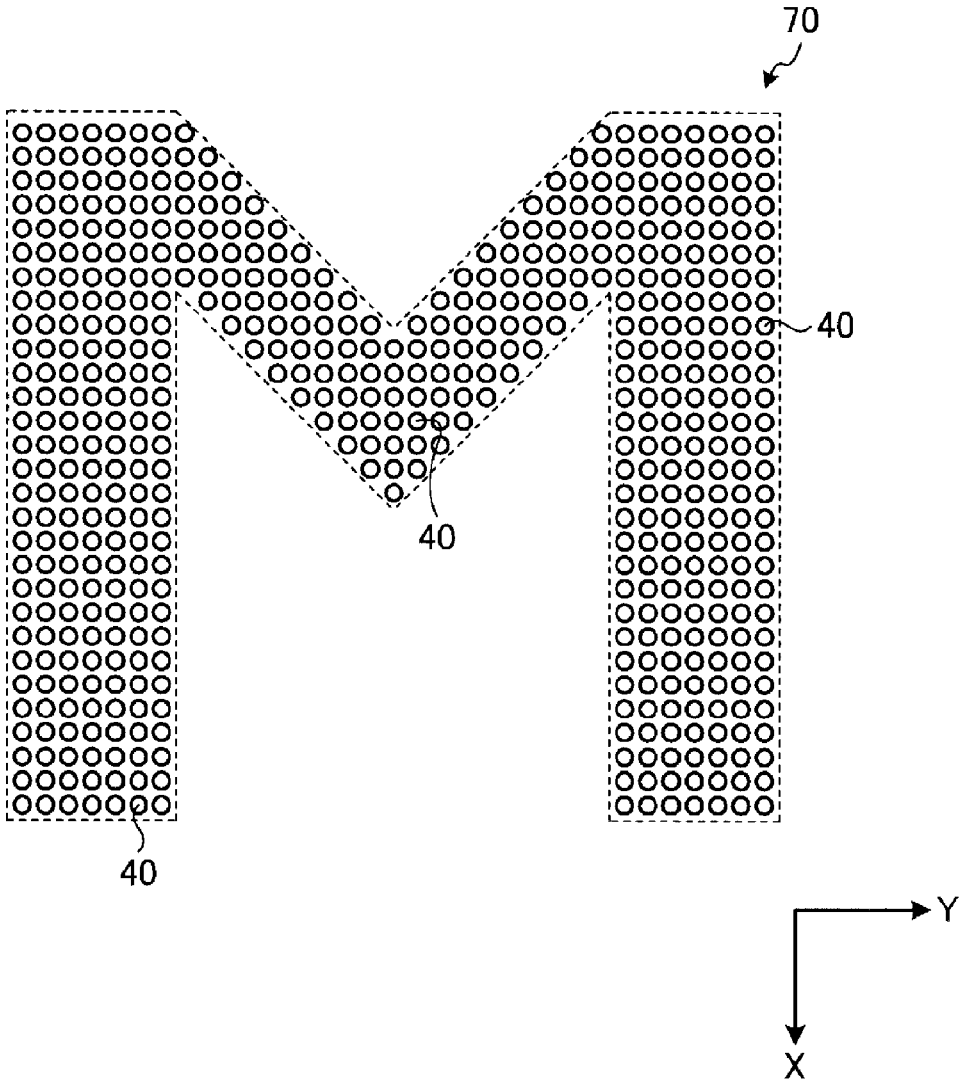
FIG. 9 is a view illustrating an example of a surface of a medium where recesses according to the first embodiment have been formed.

FIG. 9 is a plan view illustrating an example of the surface of the medium M after irradiation with laser light. As shown in FIG. 7, the object pattern 70 is generated by the pattern generating unit 36. On the basis of the object pattern 70, the irradiation position adjusting unit 21 determines a position on the surface of the medium M to be irradiated with laser light, and irradiates that irradiation position with laser light.

In the present embodiment, the irradiation position adjusting unit 21 adjusts the position on the medium M to be irradiated with laser light, such that the plurality of recesses 40 is formed in a pattern area 70R which is the inside of the outline (edge) 70E of the object pattern 70, whereby the object pattern 70 is formed by the plurality of recesses 40. In other words, the irradiation position adjusting unit 21 adjusts the position on the medium M to be irradiated with laser light such that the pattern is formed in the pattern area 70R of the medium M by the plurality of recesses 40. In the present embodiment, the irradiation position adjusting unit 21 repeats the operation of determining the position on the medium M to be irradiated with laser light and irradiating the medium M with laser light while moving the emitting unit 12 in the Y axis direction, and the operation of moving the medium Min the X axis direction, such that the plurality of recesses 40 is uniformly formed in the pattern area 70R of the surface of the medium M.

Also, in the pattern area 70R, the recesses 40 may be formed in a reticular shape with a fine pitch, or may be formed in a checker shape with a predetermined cycle, or may be randomly formed in a grain shape. The plurality of recesses 40 is formed, whereby protruding portions are formed between each recess 40 and neighboring recesses 40. In the present embodiment, in the pattern area 70R, the recesses and the protruding portions are formed. By irradiation with laser light, the pattern area 70R may be roughened.

After the plurality of recesses 40 is formed in the pattern area 70R by irradiation with laser light, the inkjet head 4 ejects ink from the ejection port 11, thereby supplying the ink onto the surface of the medium M irradiated with the laser light (STEP SA4).

Figure 10:
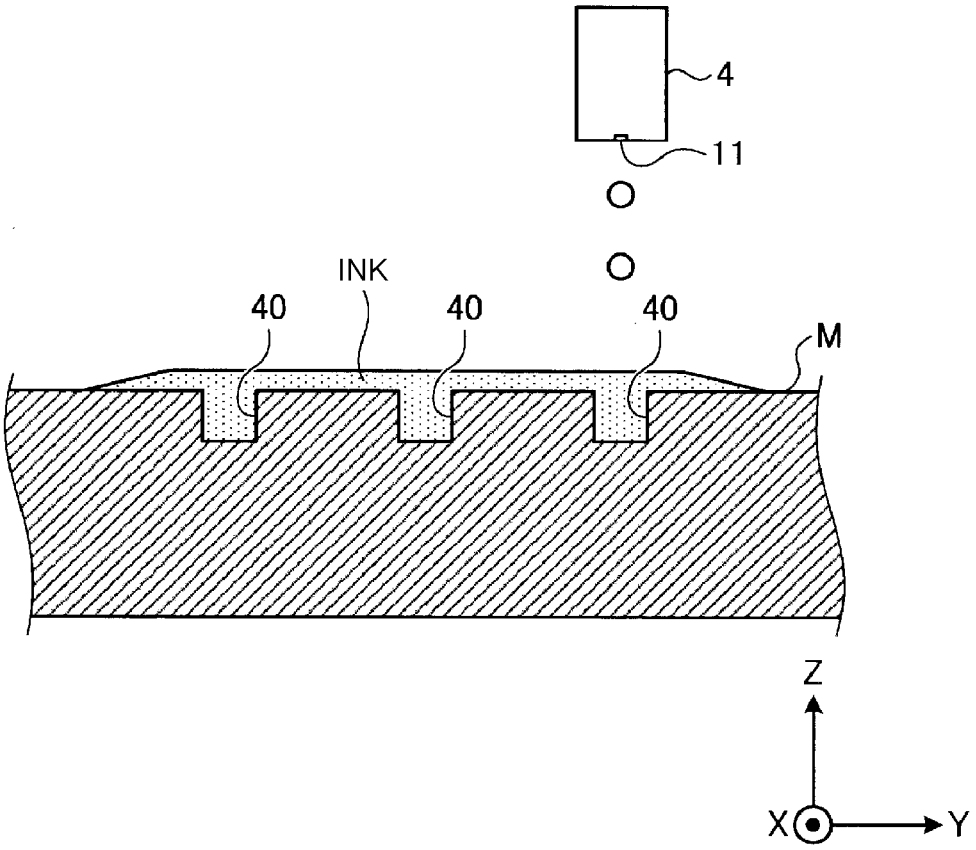
FIG. 10 is a schematic diagram illustrating an example of an operation of the inkjet head according to the first embodiment.

FIG. 10 is a cross-sectional view schematically illustrating an example of the ink supplied onto the surface of the medium M having the recesses 40 formed therein. If ink ejected from the ejection port 11 is supplied onto the surface of the medium M, at least a portion of the supplied ink enters the recesses 40. The ink enters the recesses 40 formed in the medium M and hardens, whereby the ink can adhere to the medium M with high adhesiveness.

Figure 11:
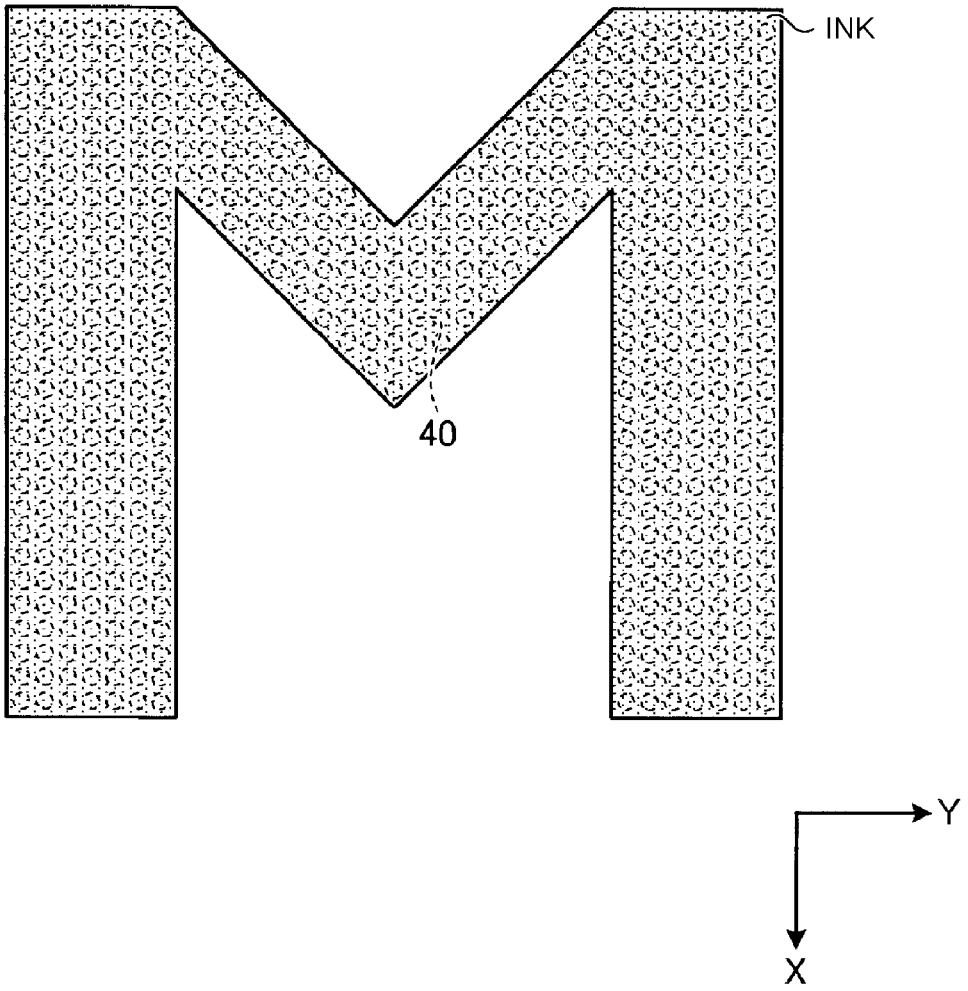
FIG. 11 is a view illustrating an example of a surface of a medium where ink according to the first embodiment has been supplied.

FIG. 11 is a plan view illustrating an example of the surface of the medium M after supply of ink. The supply position adjusting unit 22 adjusts the ink supply position on the medium M such that ink is supplied onto the pattern area 70R. On the basis of the object pattern 70, the supply position adjusting unit 22 determines the ink supply position on the surface of the medium M, and supplies ink onto that supply position. In the present embodiment, the supply position adjusting unit 22 repeats the operation of determining the ink supply position on the medium M such that ink is supplied onto the pattern area 70R of the surface of the medium M, and supplying ink onto the medium M while moving the ejection port 11 in the Y axis direction, and the operation of moving the medium M in the X axis direction.

As described above, according to the present embodiment, fine recesses 40 can be smoothly formed in media M made of a variety of materials by irradiating the media M with laser light. After the recesses 40 are formed, ink is supplied onto the media M, whereby the ink enters the recesses 40 and hardens. As a result, the ink can adhere to the media M with high adhesiveness. In other words, in the present embodiment, the inkjet printer 1 uses a so-called anchor effect (a physical effect) that ink having entered the recesses 40 is held in the recesses 40, to make ink adhere to the media M with high adhesiveness. Therefore, even if ink and a medium M having low chemical affinity are combined, it is possible to obtain high adhesiveness using the physical effect. Therefore, even if ink is supplied onto a medium M made of a material having low chemical affinity for the ink, printing is satisfactorily performed on that medium M with the ink. Therefore, even if media M made of a variety of materials are used, it is possible to satisfactorily perform printing those media M with ink.

Also, in the present embodiment, the inkjet printer 1 adjusts the position on the medium M to be irradiated with laser light, and forms the plurality of recesses 40 in the pattern area 70R of the medium M, and then adjusts the ink supply position on the medium M, thereby supplying ink onto the pattern area 70R. In this way, the desired pattern can be smoothly formed on the medium M.

Also, in the present embodiment, on the basis of the data on the material (heat resistance) of the medium M, the emission condition adjusting unit 32 adjusts the quantity of irradiation of the medium M with laser light, such that the recesses 40 having the desired depth are formed. Therefore, it is possible to prevent a situation in which the medium M is cut, and a situation in which through-holes are formed in the medium M, and a situation in which the recesses 40 are not formed in the medium M.

Also, in the present embodiment, in a case where ink is ultraviolet curing ink, after ink is supplied from the ejection port 11 onto a medium M, the control device 9 emits ultraviolet light from the emitting unit 14 of the ultraviolet-light irradiator 13, thereby irradiating the ink on the medium M with that ultraviolet light. Therefore, hardening of the ink is promoted, and higher adhesiveness is obtained. Also, as ultraviolet curing ink, cation ink having little shrinkage during hardening is preferable.

Also, the emission condition adjusting unit 32 may adjust the quantity of irradiation with laser light such that at least a portion of the medium M is cut by the laser light. For example, the emission condition adjusting unit 32 may operate the laser light irradiator 18 with high power, thereby cutting the medium M by the laser light, or may operate the laser light irradiator 18 with low power, thereby forming fine recesses 40 as described above, or may operate the laser light irradiator 18 with medium power, thereby forming recesses larger (deeper) than the recesses 40, thereby forming a mark on the medium M. In this way, the laser light irradiation device 5 can fulfill a surface modification function of forming fine recesses 40 in a surface of a medium M, thereby improving the affinity of the surface of the medium M for ink, a laser cutter function of cutting at least a portion of a medium M, and a laser marking function of forming a mark on a medium M. The inkjet printer 1 can fulfill a printing function, a cutting plotter function, and the laser marking function.

<Second Embodiment>

A second embodiment will be described. In the following description, component identical or equivalent to those of the above-described embodiment are denoted by the same reference symbols, and a description thereof will be made in brief or will not be made.

Figure 12:
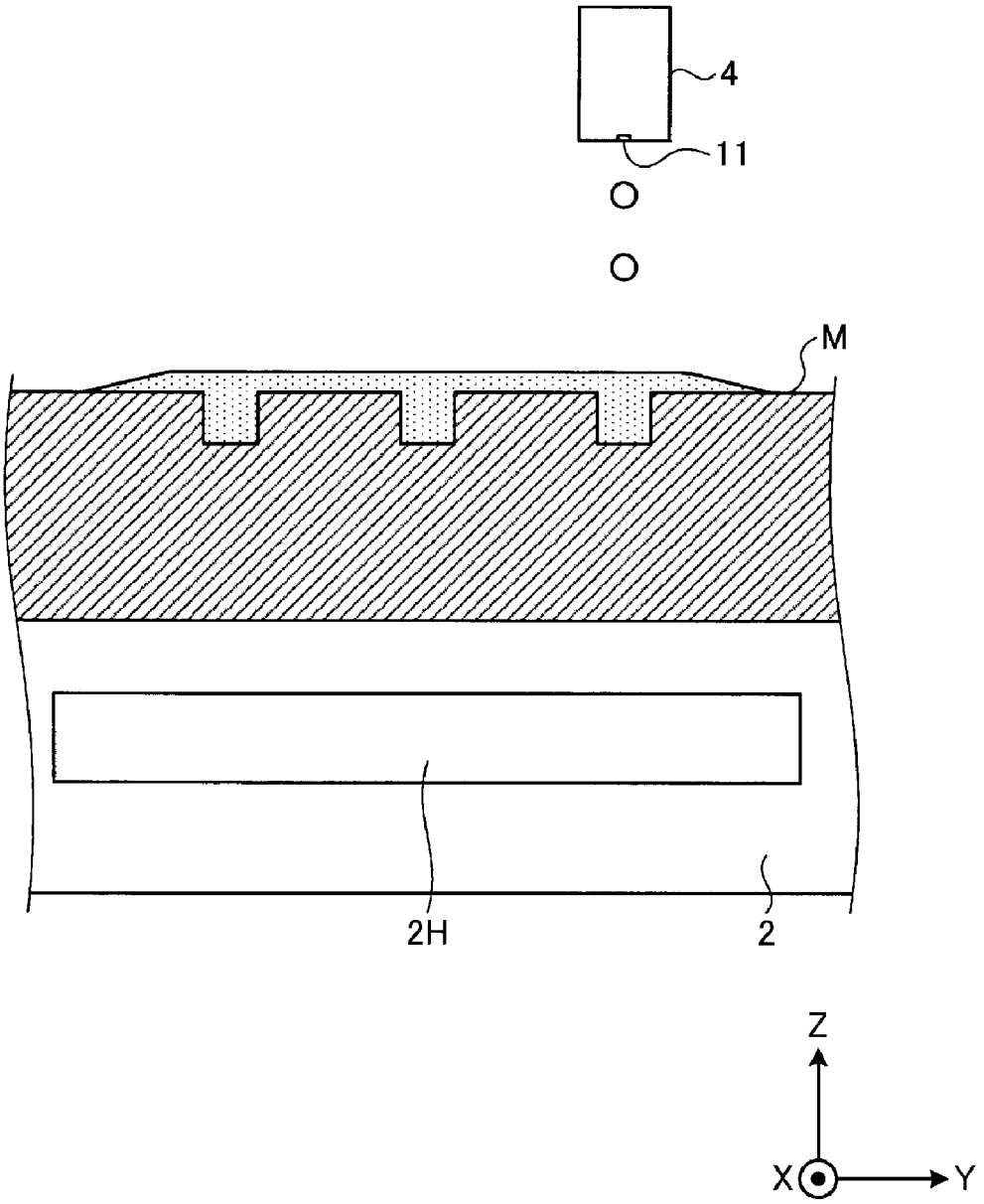
FIG. 12 is a schematic diagram illustrating an example of an inkjet printer according to a second embodiment.

FIG. 12 is a view schematically illustrating an example of an inkjet printer 1 according to the present embodiment. In the present embodiment, the inkjet printer 1 includes a heating device 2H for heating a medium M with respect to supply of ink. In the present embodiment, the heating device 2H is disposed on the supporting unit 2. The heating device 2H can heat a medium M supported on the supporting unit 2.

The control device 9 may heat a medium M with the heating device 2H, in parallel to an operation of supplying ink from the ejection port 11 onto the medium M, or may heat a medium M with the heating device 2H after an operation of supplying ink from the ejection port 11 onto the medium M is completed.

As described above, according to the present embodiment, since a medium M is heated with respect to supply of ink, it becomes possible to dry ink adhering to the medium M by evaporating a solvent contained in the ink, and thus it is possible to further improve the adhesiveness between the ink and the medium M.

<Third Embodiment>

A third embodiment will be described. In the following description, component identical or equivalent to those of the above-described embodiments are denoted by the same reference symbols, and a description thereof will be made in brief or will not be made.

Figure 13:
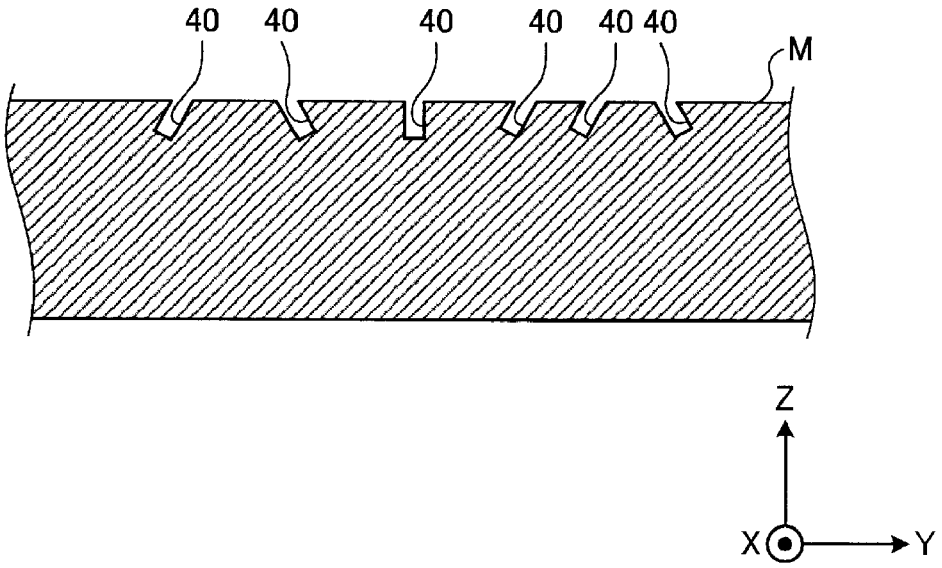
FIG. 13 is a cross-sectional view illustrating an example of a medium where recesses according to a third embodiment have been formed.

FIG. 13 is a cross-sectional view schematically illustrating an example of a medium M according to the present embodiment. As described with reference to FIG. 5 and the like, the emission position adjusting unit 31 can adjust an incident angle θ of laser light on a surface of a medium M by adjusting the position (posture) of the laser light irradiator 18.

As shown in FIG. 13, the control device 9 may form recesses 40 at various angles in a surface of a medium M. For example, a plurality of recesses 40 which is formed in the pattern area 70R may be formed at different angles, respectively. In this case, an anchor effect according to the angles of the recesses 40 is expected, and it is possible to further improve the adhesiveness between ink and the medium M.

<Fourth Embodiment>

A fourth embodiment will be described. In the following description, component identical or equivalent to those of the above-described embodiments are denoted by the same reference symbols, and a description thereof will be made in brief or will not be made.

Figure 14:
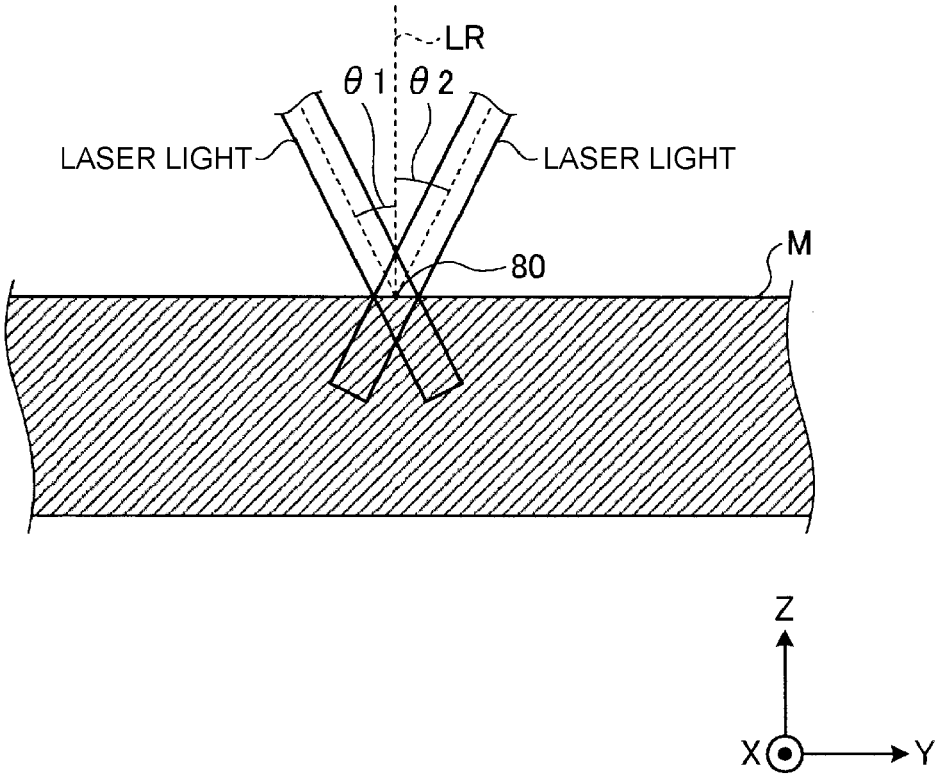
FIG. 14 is a schematic diagram illustrating an example of a printing method according to a fourth embodiment.

FIG. 14 is a cross-sectional view schematically illustrating an example of a medium M according to the present embodiment. As described above, the emission position adjusting unit 31 can adjust an incident angle θ of laser light on a surface of a medium M by adjusting the position (posture) of the laser light irradiator 18.

In the present embodiment, the emission position adjusting unit 31 adjusts the incident angle θ such that laser light obliquely enters a region 80 of the surface of the medium M. As shown in FIG. 14, in the present embodiment, the emission position adjusting unit 31 adjusts the incident angle θ of the laser light such that laser light enters the region 80 of the surface of the medium M at a first incident angle θ1 and enters that region 80 at a second incident angle θ2 different from the first incident angle θ1. The first incident angle θ1 and the second incident angle θ2 are inclination angles relative to a reference line LR passing through the region 80 and perpendicular to the surface of the medium M (the X-Y plane).

In the example shown in FIG. 14, with respect to the reference line LR, the absolute value of the first incident angle θ1 and the absolute value of the second incident angle θ2 are the same. Laser light which enters at the first incident angle θ1 obliquely enters the region 80 from the negative Y side. Laser light which enters at the second incident angle θ2 obliquely enters the region 80 from the positive Y side.

Also, while maintaining the incident angle θ on the region 80 at a constant value, the control device 9 turns laser light around the reference line LR, such that the laser light obliquely enters the region 80.

Figure 15:
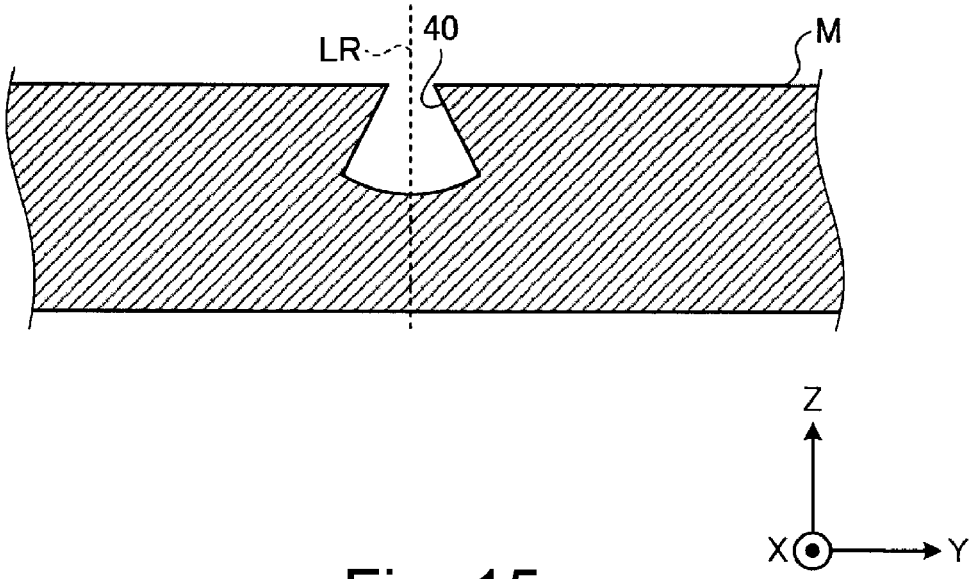
FIG. 15 is a schematic diagram illustrating the example of the printing method according to the fourth embodiment.
Figure 16:
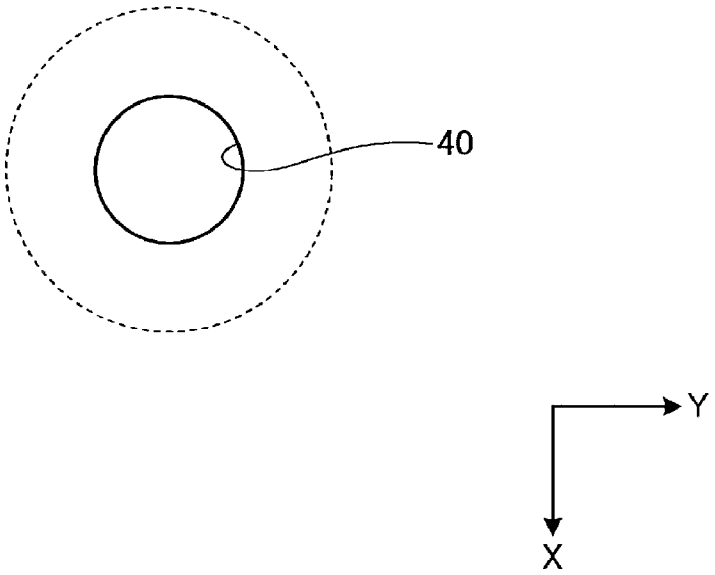
FIG. 16 is a schematic diagram illustrating the example of the printing method according to the fourth embodiment.

FIG. 15 is a cross-sectional view schematically illustrating an example of a recess 40 formed by turning laser light around the reference line LR so as to make the laser light obliquely enter the region 80 while maintaining the incident angle θ on the region 80 at a constant value. FIG. 16 is a plan view of the recess 40 of FIG. 15 as seen from the above.

As shown in FIG. 15 and FIG. 16, in the X-Y plane parallel to the surface of the medium M, the size of the bottom of the recess 40 is larger than the size of the opening of the upper end of the recess 40. With respect to a direction (the Z axis direction) parallel to the reference line LR, the inner surface of the recess 40 is inclined so as to widen as it goes from the opening of the upper end toward the bottom.

Figure 17:
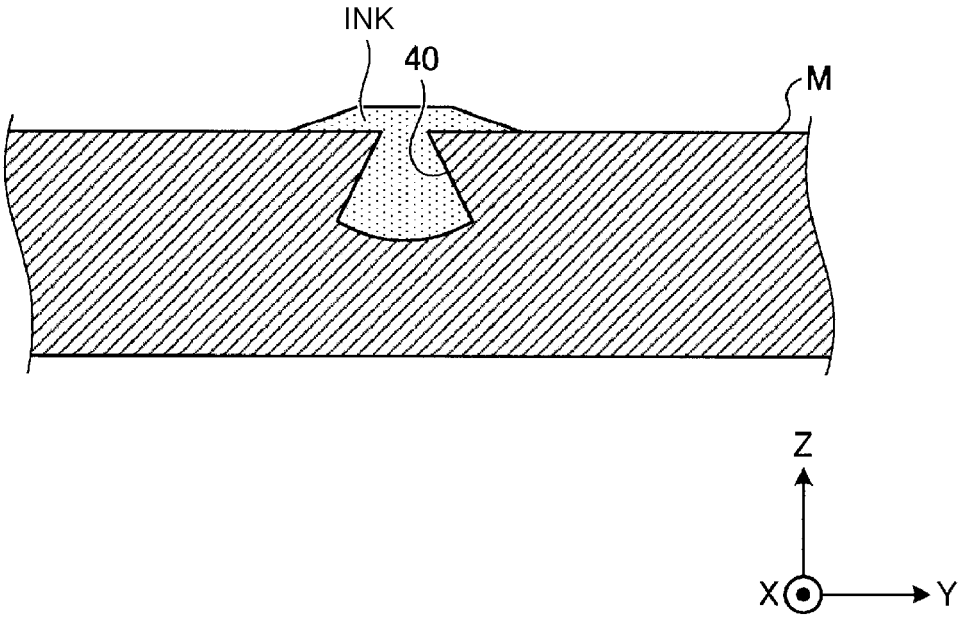
FIG. 17 is a schematic diagram illustrating the example of the printing method according to the fourth embodiment.

FIG. 17 is a cross-sectional view schematically illustrating an example of a state where ink has entered the recess 40 shown in FIG. 15. In FIG. 17, the ink having entered in the recess 40 hardens so as not to slip out of the recess 40, and thus can adhere to the medium M with high adhesiveness by a high anchor effect.

As described above, according to the present embodiment, it is possible to smoothly form a recess 40 having a shape in which the size of the bottom of the recess 40 is larger than the size of the opening of the upper end of the recess 40, by making laser light obliquely enter the same region 80 of the surface of the medium M at various incident angles θ. The recess 40 having that shape produces a high anchor effect. Therefore, it is possible to make ink adhere to the medium M with high adhesiveness.

Figure 18:
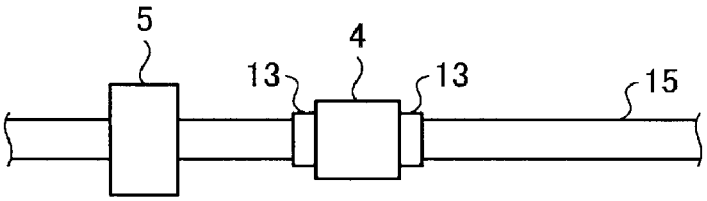
FIG. 18 is a view schematically illustrating an example of an inkjet printer.
Figure 19:
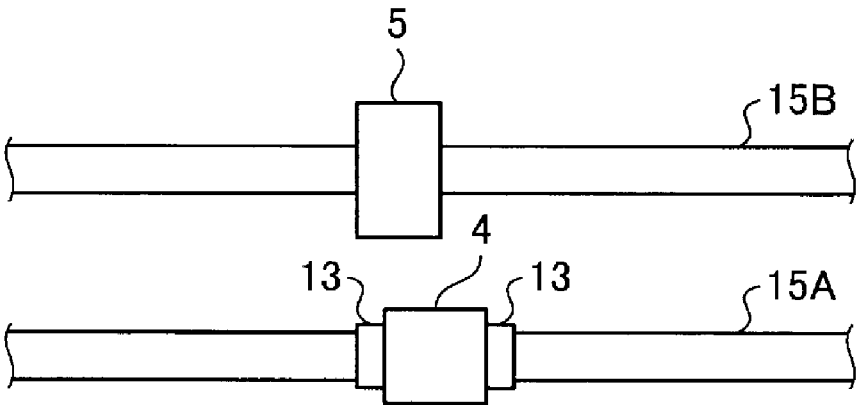
FIG. 19 is a view schematically illustrating an example of the inkjet printer.

Also, in the above-described embodiment, as shown in the schematic diagram of FIG. 18, on one guide member 15, the laser light irradiation device 5 and the carriage 6 (the inkjet head 4 and the ultraviolet-light irradiator 13) are supported. As shown in FIG. 19, the inkjet head 4 and the ultraviolet-light irradiator 13 may be supported on a guide member 15A so as to be movable, and the laser light irradiation device 5 may be supported on a guide member 15B different from the guide member 15A so as to be movable.

Figure 20:
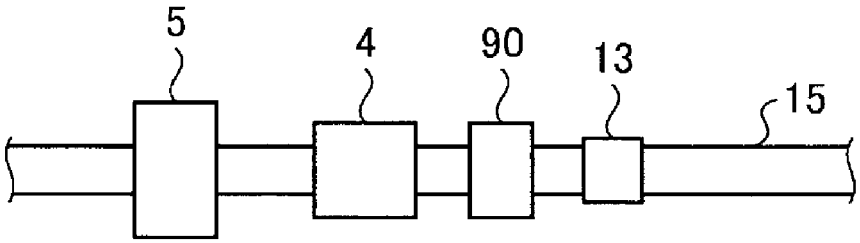
FIG. 20 is a view schematically illustrating an example of the inkjet printer.

Also, as shown in FIG. 20, the inkjet printer 1 may include a primer print head 90. The primer print head 90 ejects ink (primer ink) for forming a primer layer on a medium M. The primer ink ejected from the primer print head 90 is supplied onto the medium M, whereby a primer layer is formed on the medium M. If primer ink is supplied onto a medium M having recesses 40 formed therein, even inside the recesses 40, a primer layer is formed. After a primer layer is formed on a medium M, ink is ejected from the inkjet head 4. Affinity (adhesiveness) between the primer layer and the medium M is higher than affinity between the ink and the medium M. Affinity between the primer layer and the ink is higher than affinity between the medium M and the ink. Therefore, if a primer layer is formed on a medium M, and then ink is supplied onto the primer layer, it is possible to further improve adhesiveness between the medium M and the ink.

Figure 21:
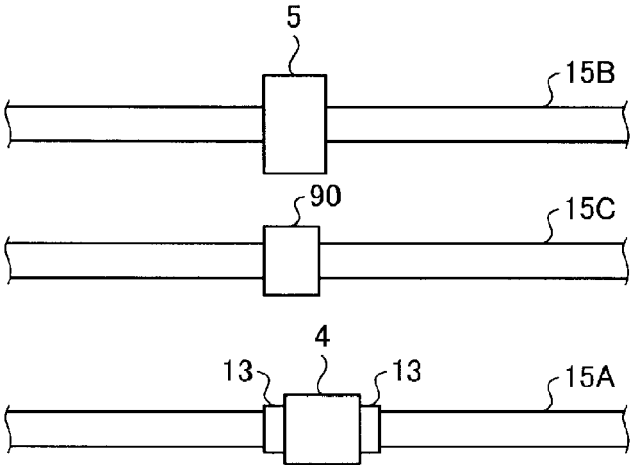
FIG. 21 is a view schematically illustrating an example of the inkjet printer.

Also, as shown in FIG. 21, the inkjet head 4 and the ultraviolet-light irradiator 13 may be supported on the guide member 15A so as to be movable, and the laser light irradiation device 5 may be supported on the guide member 15B different from the guide member 15A so as to be movable, and the primer print head 90 may be supported on a guide member 15C different from the guide member 15A and the guide member 15B so as to be movable.

<Fifth Embodiment>

A fifth embodiment will be described. In the following description, component identical or equivalent to those of the above-described embodiments are denoted by the same reference symbols, and a description thereof will be made in brief or will not be made.

In each embodiment described above, the medium moving device 3, the inkjet head 4, the laser light irradiation device 5, and the like are disposed inside the housing 50 of the inkjet printer 1. In the present embodiment, an example in which a medium moving device 3S having a supporting unit 2S for supporting a medium M, a laser light irradiation device 5S, and an inkjet device 4S are separate devices will be described.

Figure 22:
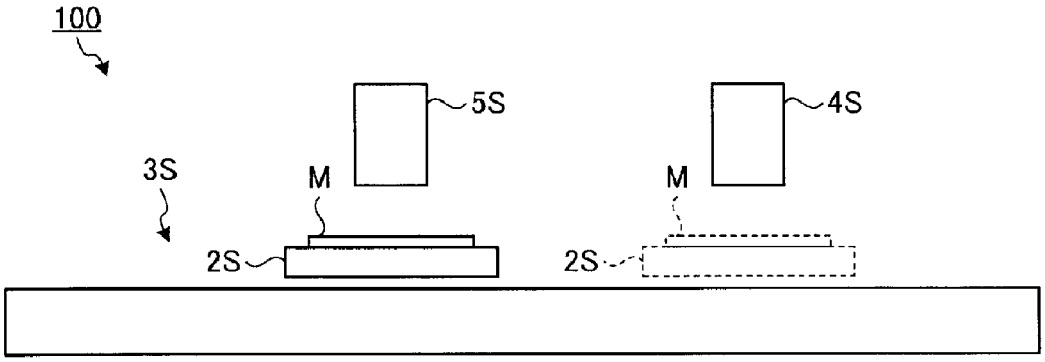
FIG. 22 is a schematic diagram illustrating an example of a printing system according to a fifth embodiment.

FIG. 22 is a schematic diagram illustrating an example of a printing system 100 according to the present embodiment. As shown in FIG. 22, the printing system 100 includes the medium moving device 3S which has the supporting unit 2S for supporting each medium M and moves each medium M supported on the supporting unit 2S, the laser light irradiation device 5S which is disposed on a path which each medium M is moved by the medium moving device 3S, and irradiates a surface of each medium M with laser light, and an inkjet device 4S which is disposed on the movement path for media M and includes an inkjet head for supplying ink onto a surface of each medium M.

The laser light irradiation device 5S irradiates a surface of a medium M supported on the supporting unit 2S with the laser light, thereby forming recesses 40 in at least a portion of the surface of the medium M. The inkjet device 4S ejects ink, thereby supplying the ink onto the surface of the medium M supported on the supporting unit 2S and irradiated with the laser light.

As described above, even in the present embodiment, it is possible to make ink adhere to media M with high adhesiveness, and it is possible to satisfactorily form images on media M with ink.

What is claimed is:

1. An inkjet printer comprising:

a laser light irradiation device configured to irradiate a surface of a medium with laser light, thereby forming recesses in at least a portion of the surface of the medium;

an inkjet head configured to supply ink onto the surface of the medium having the recesses formed therein; and an incident-angle adjusting unit configured to adjust an incident angle of the laser light on the surface of the medium, wherein the incident-angle adjusting unit adjusts the incident angle such that the laser light enters one region of the surface of the medium at a first incident angle, and enters the one region at a second incident angle different from the first incident angle.

2. The inkjet printer according to claim 1, further comprising:

an irradiation position adjusting unit configured to adjust a position on the medium to be irradiated with the laser light such that a plurality of the recesses is formed inside an outline of a pattern to be formed on the medium; and a supply position adjusting unit configured to adjust a supply position of the ink on the medium such that the ink is supplied to the recesses formed inside the outline of the pattern.

3. The inkjet printer according to claim 1, further comprising:

an irradiation quantity adjusting unit configured to adjust a quantity of irradiation of the medium with the laser light, wherein the irradiation quantity adjusting unit adjusts the quantity of irradiation with the laser light such that at least a portion of the medium is cut by the laser light.

4. The inkjet printer according to claim 1, further comprising:

a heating device configured to heat the medium with respect to supply of the ink.

5. A printing method comprising:

a process of irradiating a surface of a medium with laser light, thereby forming recesses in at least a portion of the surface of the medium;

a process of adjusting an incident angle of the laser light on the surface of the medium, such that the laser light enters one region of the surface of the medium at a first incident angle, and enters the one region at a second incident angle different from the first incident angle; and a process of supplying ink onto the surface of the medium irradiated with the laser light, thereby forming an image on the medium.

6. A printing system comprising:

a medium moving device configured to have a supporting unit for supporting a medium and to move the medium supported on the supporting unit;

a laser light irradiation device configured to irradiate a surface of the medium supported on the supporting unit with laser light, thereby forming recesses in at least a portion of the surface of the medium;

an inkjet device configured to eject ink, thereby supplying the ink onto the surface of the medium having the recesses formed therein; and an incident-angle adjusting unit configured to adjust an incident angle of the laser light on the surface of the medium, wherein the incident-angle adjusting unit adjusts the incident angle such that the laser light enters one region of the surface of the medium at a first incident angle, and enters the one region at a second incident angle different from the first incident angle.

* * * * *